United States Patent [19]

Neiss

[11] 4,269,359

[45] May 26, 1981

[54] VALVE CONSTRUCTION FOR PRESSURIZED FLOW OF ABRASIVE GRANULAR MATERIAL

[76] Inventor: Lynn R. Neiss, 4680 Alabama Ave., Navarre, Stark County, Ohio 44662

[21] Appl. No.: 916,716

[22] Filed: Jun. 19, 1978

[51] Int. Cl.[3] ..... B24C 5/02

[52] U.S. Cl. ..... 239/530; 51/427; 239/586; 251/65; 251/303

[58] Field of Search ..... 251/65, 298, 299, 303; 222/517; 51/427, 439; 239/525, 526, 530, 569, 578, 583, 586

[56] References Cited

U.S. PATENT DOCUMENTS

| | | | |
|---|---|---|---|
| 191,964 | 6/1877 | Holloway | 239/569 |
| 388,159 | 8/1888 | Tomlinson | 239/569 X |
| 708,537 | 9/1902 | Esch | 239/530 |
| 1,392,632 | 10/1921 | Flanders | 251/65 X |
| 2,099,847 | 11/1937 | Gebauer et al. | 222/517 X |
| 3,618,263 | 11/1971 | Weijsenburg | 51/427 |

*Primary Examiner*—Andres Kashnikow

*Attorney, Agent, or Firm*—Harvey B. Jacobson

[57] ABSTRACT

A valve intended primarily for use on the end of a supply hose for directing and controlling a high velocity stream of an abrasive granular material against an object. The valve has a handle with a usual discharge nozzle mounted on one end thereof, with the granular material supply hose being connected to the other end of the handle. A lever is pivotally mounted on the handle and is movable between open and closed positions with respect to the nozzle. The lever has a hand-actuated inner end portion and a nozzle sealing outer end portion. A spring is mounted on the lever and biases the lever toward closed position. A resilient sealing member is mounted on the outer end of the lever and forms a seal completely external of the nozzle against the open discharge end of the nozzle when the lever is in closed position. Magnets may be mounted on the handle and inner end of the lever and are mutually engageable when the lever is in open position to assist an operator in overcoming the biasing effect of the spring.

4 Claims, 9 Drawing Figures

VALVE CONSTRUCTION FOR PRESSURIZED FLOW OF ABRASIVE GRANULAR MATERIAL

BACKGROUND OF THE INVENTION

1. Field of the Invention

The invention relates to valves, and in particular to a valve for use in directing and controlling a high velocity stream of abrasive granular material. More particularly, the invention relates to a valve for a pressure-fed sandblaster having external shut-off means on the nozzle portion of the valve for controlling the spray of high velocity granular material.

2. Description of the Prior Art

The use of high pressure air for discharging a stream of an abrasive granular material for removing paint and rust from objects, such as car bodies, metal parts, building exteriors and the like, has been practiced for numerous years, much of which is commonly referred to as sandblasting. In this procedure, silica sand, glass beads or other granular materials are mixed with a stream of high pressure air and discharged through a nozzle which is held either manually or mechanically for directing the stream of the abrasive particles against the object being treated.

More recently, small portable pressure-fed blasters have been devised for smaller jobs than the heretofore large buildings, wherein a supply of compressed air is connected to a portable tank containing a predetermined amount of sand which is mixed with the pressure air stream. A manual valve is mounted on the end of a hose for turning on and shutting off the high velocity flow of granular material. A nozzle is incorporated in this valve for discharging the stream of abrasive particles and directing it against the object being cleaned with a sufficiently high velocity.

These valves use a manually operated ball-type shut-off mechanism in which a metal shut-off ball is mounted internally within the valve body and controlled by an external rotatable handle. This arrangement satisfactorily stops and starts the flow of abrasive material through the nozzle. However, problems arise in the use of such valves in that, when the valve is not rotated to a fully open or fully closed position, the abrasive material will continue to flow throughout the valve and out of the nozzle. The abrasive material, upon flowing in a somewhat irregular path through the partly opened or closed ball valve, quickly wears away or damages the metal ball valve and even the valve body. Thus, in a relatively short period of time, the ball or valve body is destroyed if operated in such a partly open or closed position, requiring replacement of the entire valve. These prior valves also require the use of both hands for their operation, one hand for holding the valve and the other hand for rotating the control lever.

An unsafe condition also is presented with these known manually operated hand-held valves since the valve remains open if dropped accidentally by a workman. The trailing hose and valve, due to the air pressure flowing therethrough, could whip about seriously injuring the operating or bystander or damaging equipment in the area since the valve remains in the open position until manually rotated to off position.

Therefore, these existing vaves provide both safety and maintenance problems and increased cost to the users thereof.

No valve construction for use with a high velocity stream of an abrasive granular material, of which I am aware, had eliminated the problems of repeated replacement and damage of the internal shut-off mechanism and the elimination of an unsafe condition if the valve is dropped during use, by a relatively simple external shut-off sealing member which returns automatically to a fully closed or shut-off position if not manually restrained in the open position.

SUMMARY OF THE INVENTION

Objectives of the invention include providing a valve construction for controlling and directing the flow of a high pressure stream of an abrasive granular material which has a completely external sealing member for stopping the flow of the material from the nozzle outlet opening, eliminating the heretofore premature wear of an internal shut-off valve control member; providing such a valve constuction in which the shut-off sealing member is mounted on a lever which is spring biased toward closed position, whereby the valve shuts off completely and automatically if accidentally dropped by a workman; providing such a valve construction in which magnets are mounted on the valve body and lever operating handle and are mutually engaged when the valve is in open position to assist an operator in overcoming the return bias of the spring to reduce fatigue on the operator; providing such a valve construction in which the external shut-off sealing member can be used with a usual nozzle of the type being used with the internal shut-off ball valve, thereby eliminating the need for special components and eliminating increased cost; providing such a valve construction in which the sealing member is an extremely inexpensive component, preferable formed of a resilient elastomer material, which if damaged by the high velocity stream of abrasive material, can be replaced quickly and conveniently by an operator for a fraction of the cost heretofore required to replace the entire internally operated valve body; providing such a valve construction in which the sealing member lever and its pivoting mounting mechanism can be molded easily and inexpensively of a synthetic plastic or similar type of material; providing such a valve mechanism which can be operated entirely by one hand freeing the operator's other hand for performing associated work during the cleaning operation; and providing such a valve construction which is relatively simple in construction, operation and use, which reduces maintenance problems and costs, which is sturdy and durable in use, which achieves the stated objectives in a simple, effective and inexpensive manner, and which solves provlems and satisfies needs existing in the art.

These and other objectives and advantages may be obtained by the valve construction of the type for use in controlling the flow of an abrasive granular material, the general nature of which may be stated as including handle means having an outlet nozzle and a supply inlet opening communicating with said nozzle, the inlet opening being adapted to receive a quantity of an abrasive granular material under pressure, said nozzle terminating in a discharge outlet opening for directing a spray of the granular material against an object; lever means movably mounted on the handle means for movement between open and closed positions; spring means biasing the lever means toward closed position; and sealing means mounted on the lever means for movement with said lever means, said sealing means externally blocking the outlet opening of the nozzle when the lever means is in closed position to prevent flow of a granular material from the nozzle.

BRIEF DESCRIPTION OF THE DRAWING

A preferred embodiment of the invention—illustrative of the best mode in which applicant has contemplated applying the principles—is set forth in the following description and shown in the drawing and is particularly and distinctly pointed out and set forth in the appended claims.

Similar numerals refer to similar parts throughout the drawings.

DESCRIPTION OF THE PREFERRED EMBODIMENT

Figure 2:
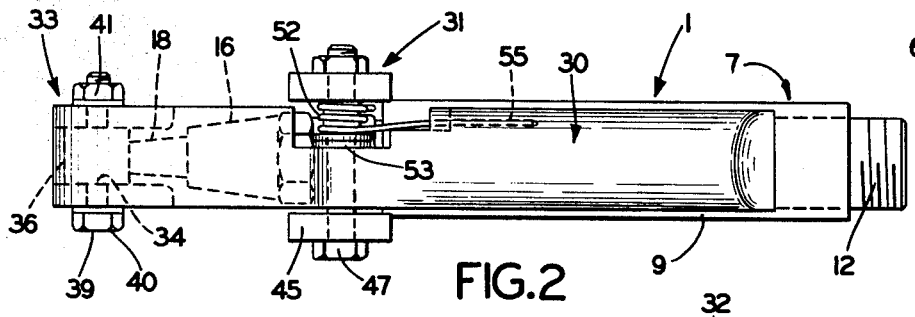
FIG. 2 is an enlarged top plan view of the improved valve construction of FIG. 1.
Figure 1:
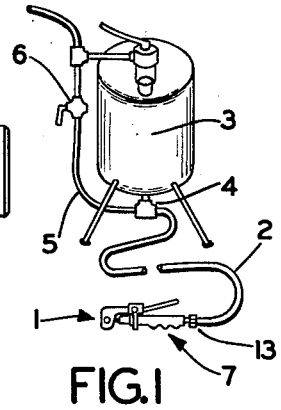
FIG. 1 is a diagrammatic perspective view of the improved valve construction mounted on the end of a hose connected to a portable pressure-fed sandblaster.

The valve construction of the invention is indicated generally at 1, and is shown in FIG. 1 connected to a length of high pressure air hose 2. A tank 3 is adapted to receive a predetermined quantity of an abrasive granular material, such as silica sand, glass beads, etc. This material is drawn into air hose 2 at a connector 4 formed at a junction with a second section of high pressure air hose 5. Hose 5 is connected to a source of air pressure, such as a compressor (not shown) and may have a control valve 6 mounted therein. The particular pressure-fed blaster equipment shown in FIG. 1 is merely one type of such equipment with which valve 1 may be used, and is for illustrative purposes only and forms no part of the invention.

Figure 3:
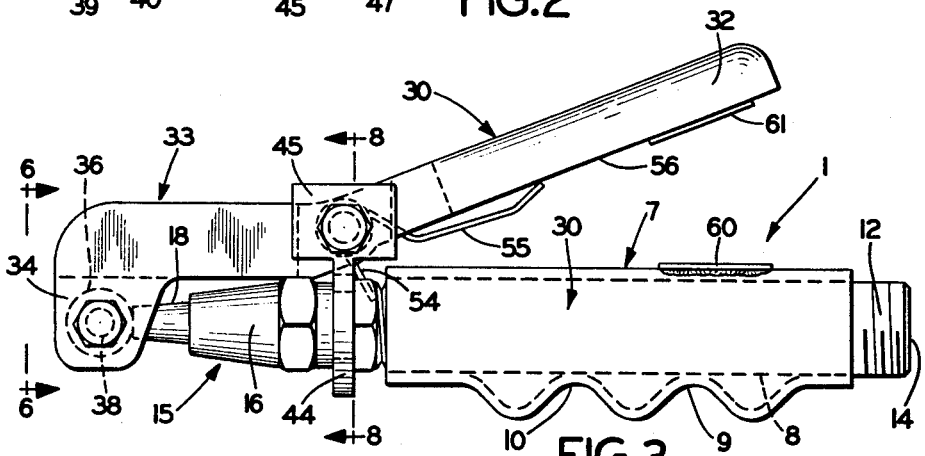
FIG. 3 is a side elevational view of the valve construction shown in FIG. 2 in a closed or shut-off position.
Figure 4:
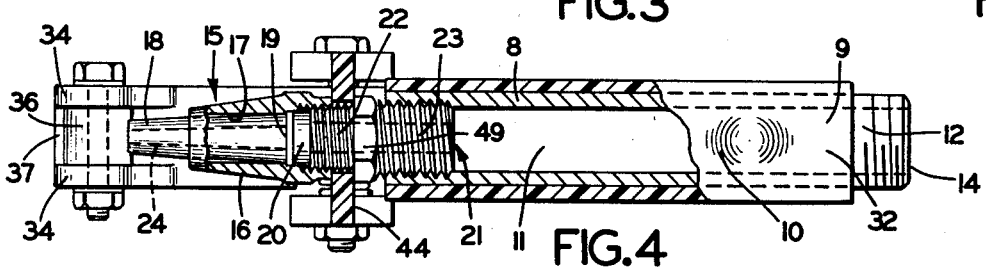
FIG. 4 is a bottom plan view of the valve shown in FIGS. 2 and 3 with portions broken away and insection.
Figure 5:
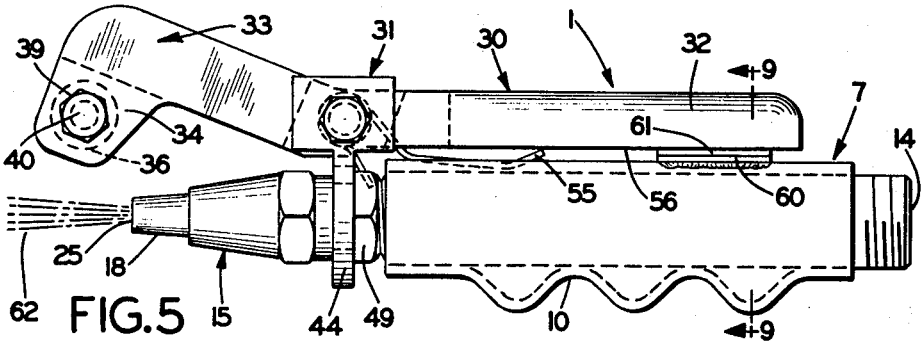
FIG. 5 is a side elevational view similar to FIG. 3 with the valve shown in open position.
Figure 9:
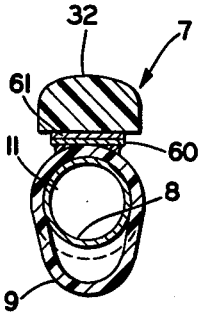
FIG. 9 is a sectional view taken on line 9—9, FIG. 5.

Valve 1 is shown particularly in FIGS. 2-5, with FIGS. 3 and 5 illustrating valve 1 in closed (shut-off) and open positions, respectively. Valve 1 includes a handle, indicated generally at 7, which is adapted to be gripped by an operator. Handle 7 includes a short section of preferably rigid pipe 8 having a resilient outer gripping sleeve 9 telescopically mounted thereon. Sleeve 9 may be formed with a plurality of finger receiving depressions 10. Pipe 8 is formed with a hollow interior or bore 11 and terminates in a threaded inlet end 12 for connection to high pressure air hose 2 by a coupling 13.

A nozzle, indicated generally at 15, is threadably connected to the outlet end of pipe 8 (FIG. 4) for discharging an abrasive granular material in a high velocity spray which enters inlet end opening 14 of pipe 8 through hose section 2. Nozzle 15 is of a usual construction and may be of the type presently used with the internal ball-type shut-off valve which is being eliminated by valve construction 1.

Nozzle 15 includes a conical-shaped outer nose 16 having a bore 17 in which a ceramic nozzle tip 18 is telescopically mounted. A rubber bushing or O-ring 19 abuts the inlet end of ceramic tip 18 and is secured in nose 16 by the forward end 20 of a threaded coupling, indicated generally at 21. Coupling 21 includes a pair of threaded ends 22 and 23 which may be of different size diameters, and which are threadably engaged with nozzle nose 16 and pipe 8, respectively. Nozzle tip 18 is formed with a hollow central bore 24, which terminates in a discharge outlet opening 25.

Figure 8:
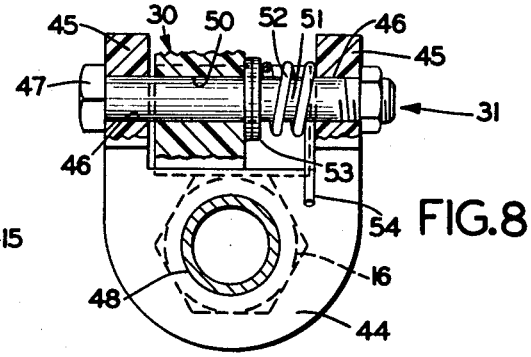
FIG. 8 is an enlarged fragmentary sectional view taken on line 8—8, FIG. 3.

In accordance with the invention, a lever indicated generally at 30, is pivotally mounted on handle 7 for movement between open and closed positions, shown in FIGS. 5 and 3, respectively. Lever 30 is pivotally mounted on handle 7 by a pivot assembly indicated generally at 31 (FIG. 8). Lever 30 preferably is formed of an injection molded plastic or similar synthetic material and includes a gripping end rear portion 32 and a nozzle seal mounting front end portion 33. Lever ends 32 and 33 form an obtuse included angle therebetween, as can be seen in FIGS. 3 and 5.

Figure 6:
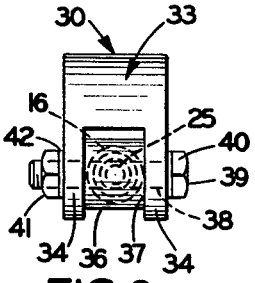
FIG. 6 is a front elevational view looking in the direction of arrows 6—6, FIG. 3.
Figure 7:
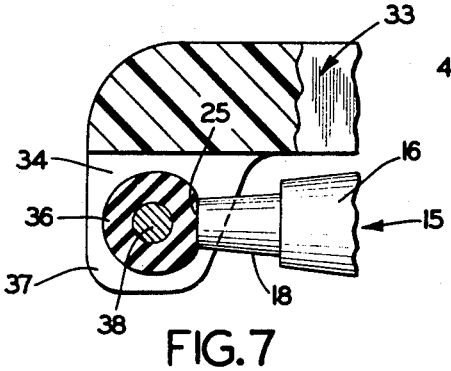
FIG. 7 is an enlarged fragmentary view with portions broken away and in section, of the front end portion of FIG. 3 showing the valve in closed position.

Lever end 33 terminates in a pair of spaced flanges 34 (FIGS. 6 and 7), which extend outwardly therefrom in a generally perpendicular transverse direction with respect to the longitudinal axis of handle 7. A nozzle sealing member 36 is mounted within a space 37 which is formed between flanges 34 and is adapted to abut the outer end of nozzle tip 18 and seal against outlet opening 25, as shown in FIG. 7 when lever 30 is in closed position. Sealing member 36 preferably is formed of a short section of a resilient hollow tubular material, such as various types of rubber or other elastomer and is telescopically mounted on shank 38 of a bolt 39 between flanges 34. Bolt 39 extends through a pair of aligned holes formed in flanges 34 with bolt head 40 abutting one flange and nut 41 and associated washer 42 abutting the opposite flange (FIG. 6).

Various configurations of sealing members 36 may be used with valve 1 and may be formed of various materials other than rubber. However, it has been found that the more resilient or softer the rubber used for member 36, the less harmful effect the abrasive stream of granular material has thereon when it contacts member 36 during movement of lever 30 between open and closed positions. Likewise, sealing member 36 need not have the tubular shape as shown since other configurations may be used to effectively block or seal external discharge opening 25 of nozzle tip 18 without departing from the concept of the invention.

Pivot assembly 31 (FIG. 8) is formed by a collar 44 which has a pair of spaced upstanding projections 45, each projection being formed with an opening 46 for receiving and mounting a pivot bolt 47 therein. Collar 44 is formed with a central opening 48 for reeceiving threaded end 22 of nozzle 15. Collar 44 is clamped against the inner end of nozzle nose 16 and a hexagonal shaped flange 49 formed on nozzle 15 between threaded ends 22 and 23 (FIG. 4). Threaded advancement of nozzle nose 16 along threaded end 22 securely clamps collar 44 against nozzle flange 49 for mounting pivot assembly 31 on handle 7.

Pivot bolt 47 extends through an opening 50 formed in lever 30 at the junction of lever ends 32 and 33 for pivotally mounting lever 30 on bolt 47. A coil spring 52 is telescopically mounted on bolt shank 51 between one of the collar projections 45 and a pair of washers 53. Spring 52 terminates in a pair of projecting end portions 54 and 55 with end portion 54 abutting collar 44 and end portion 55 abutting the underside surface 56 of gripping end portion 32 of lever 30.

In accordance with another of the main features of the invention, spring 52 biases lever 30 toward the closed position of FIG. 3 and maintains sealing member 36 in sealing engagement with nozzle outlet opening 25 until lever 30 is manually operated by gripping handle 7 and lever 30, whereupon lever end portion 32 is pivoted toward handle 7.

Another feature of the invention is the mounting of a pair of mutually attractable magnets 60 and 61 on handle 7 and lever end portion 32, respectively, to assist in reducing the fatigue on an operator's hand when using valve 1 over an extended period of time. Magnets 60 and 61 are mounted on handle 7 and lever 30 by an adhesive or other attachment means and are positioned thereon to be engaged with each other, as shown in FIG. 5, when lever 30 is moved to open position. The attractive force of magnets 60 and 61 attempts to maintain lever 30 is open position by overcoming the biasing effect of spring 52, which is biasing lever 30 toward closed position in the opposite direction.

The retaining or coupling force of magnets 60 and 61 is less than the biasing force of spring 52 to prevent lever 30 from remaining in open position upon release of the lever by an operator. Also, it is readily understood that only a single magnet 60 or 61 could be used with the opposite member being a metallic plate to achieve the desired magnetic retaining force. Likewise, other types of retaining latch means could be used instead of magnets to reduce the pressure exerted by spring 52 on an operator's hand without departing from the concept of the invention.

The operation of valve 1 is easily seen and understood by an inspection of FIGS. 3, 5 and 7. An operator grips handle 7 and lever end portion 32 with one hand. Upon exertion of a gripping force on handle 7 and lever end 32, end 32 will move toward handle 7 pivoting lever end 33 away from nozzle tip 18 from the closed position of FIG. 3 to the open position of FIG. 5. A stream 62 of an abrasive granular material is ejected automatically under a relatively high pressure against an object to be cleaned thereby. The operator merely maintains lever end 32 pressed against handle 7, assisted by magnets 60 and 61, throughout the cleaning period. The operator merely releases his grip on lever 30, whereupon spring 52 automatically pivots lever 30 from the open position of FIG. 5 to the closed position of FIG. 3. Sealing member 36 (FIG. 7) automatically and effectively blocks and seals nozzle discharge end opening 25 preventing further flow of abrasive stream 62.

A typical type of portable pressure-fed sandblaster with which valve 1 may be used will have a maximum air pressure of 175 lbs/in$^2$ with a nozzle velocity of 22 CFM, although other pressures and velocity may be used satisfactorily with valve 1.

Valve construction 1 has a number of advantages not believed available in existing valve constructions for use in controlling the flow of a high pressure stream of an abrasive granular material. Sealing member 36 completely blocks and seals discharge opening 25 of nozzle tip 18 externally of nozzle 15. This external seal eliminates the undesirable wear of internal valve components, as in prior valve constructions, or the use of the valve in a partially open or closed position resulting in damage to the valve body by the nonlinear path required to be traveled by the stream of material. Furthermore, even should sealing member 36 become worn or damaged by the abrasive stream 62 during the repeated opening and closing of the valve, or even if valve 1 is operated incorrectly in a partially open position, sealing member 36 need only be replaced with a similar short section of tubing by removal of nut 41. Such replacement is performed at a fraction of the cost and time heretofore required for replacing the internal ball valve, and possibly the entire valve body as in prior valve constructions. Also, due to the biasing effect of spring 52 and the method of operating valve 1, level 30 is less likely to be operated in a partially open or closed position causing damage to sealing member 36, as with prior valve cosntructions.

Another important advantage of the valve construction 1 is the safety feature achieved by the spring biasing of lever 30 to ward closed position. Should valve 1 be dropped by an operator during use, or inadvertently laid down without moving the valve to a fully closed position, lever 30 will pivot automatically to closed position with sealing member 36 completely stopping the spray of granular material 62. This prevents any whipping action which could occur when a valve is left in an open position on the end of a length of high pressure air hose.

Other advantages are the use of magnets 60 and 61 to reduce the fatigue exerted on an operator's hand during use of valve 1 caused by the biasing of spring 52 which could become tiring when used for long intervals of time. Also, valve 1 is held and operated by only one hand eliminating two-hand operation as with prior valve constructions.

Valve 1 has a minimum number of moving parts and, except for lever 30 and collar 44 of pivot assembly 31, the remaining components of valve 1 are readily available parts which can be purchased at a relatively low cost. Lever 30 and collar 44 also may be molded of an inexpensive plastic or synthetic material.

Although the above description and accompanying drawings describe and illustrate valve 1 as being intended for use primarily for a sandblaster or other pressure blaster application for use with an abrasive granular material, it is readily understood that valve 1 could be used for other applications for stopping the flow of a fluid, liquid or other materials which are being discharged from a nozzle opening under pressure, and the scope of the invention need not be limited to a sandblaster application.

Accordingly, valve construction 1 is simplified, provides an effective, safe, inexpensive, durable and efficient device which achieves all the enumerated objectives, provides for eliminating difficulties encountered with prior devices, and solves problems and obtains new results in the art.

In the foregoing description, certain terms have been used for brevity, clearness and understanding, but no unnecesary limitations are to be implied therefrom beyond the requirements of the prior art, because such terms are used for descriptive purposes herein and are intended to be broadly construed.

Moreover, the description and illustration of the invention is by way of example, and the scope of the invention is not limited to the exact details shown or described.

Having now described the features, discoveries and principles of the invention, the manner in which the valve construction is constructed and used, the characteristics of the new construction, and the advantageous, new and useful results obtained; the new and useful structures, devices, elements, arrangements, parts, and combinations are set forth in the appended claims.

I claim:

1. A combination of a pressurized source of abrasive granular material and a valve construction for use in controlling the flow of granular material, said valve construction including:

(a) handle means having an outlet nozzle and a supply inlet opening communicating with said nozzle, the inlet opening being in communication with said pressurized source of abrasive granular material, said nozzle terminating in a discharge outlet for directing a spray of granular material against an object, said handle means including a section of rigid pipe having a first threaded end in which said outlet nozzle is threadedly engaged and a second end forming said supply inlet opening, said handle further including a flexible gripping sleeve telescopically mounted on the section of rigid pipe and containing a plurality of finger receiving depressions;

(b) lever means pivotally mounted on the handle means for movement between open and closed position, said lever means having a first gripping end portion and a second nozzle sealing end portion, said end portion forming an included obtuse angle therebetween;

(c) spring means biasing the lever means toward closed position;

(d) sealing means mounted on said second nozzle sealing end portion for movement with said lever means, said sealing means externally blocking the outlet opening of the nozzle when the lever means is in closed position to prevent flow of said granular material from the nozzle, said second nozzle sealing end portion including a pair of spaced flanges, sealing means including a hollow resilient sealing member telescopically mounted on a removable pin extending between the spaced flanges; and (e) a pivot means mounted on the handle means for pivotally mounting the lever means on the handle means for movement between the open and closed positions, said pivot means including a collar mounted around the handle means, said collar containing a central opening for receiving said handle means and further containing a pair of spaced projections formed thereon and extending therefrom, said pivot means further including a pivot pin extending transversely between said spaced projections for providing said movement, said spring means being a coil spring having a pair of outwardly extending ends, said spring being telescopically mounted on the pivot pin, one of the spring ends engaging the handle means and the other spring end engaging the lever means to bias the lever means toward closed position.

2. The combination defined in claim 1 in which magnet means is operatively engageable with the handle means and lever means when the lever means is in open position to assist an operator in retaining the lever means in open position by counteracting a portion of the biasing force of the spring means.

3. The combination defined in claim 2 in which the biasing effect of the spring means is greater than the retaining effect of the magnet means.

4. The combination defined in claim 2 in which the magnet means includes a pair of mutually attractable magnets with one of said magnets being mounted on the lever means and the other magnet being mounted on the handle means in juxtaposition with respect to said first magnet.

* * * * *